United States Patent [19]

Lee

[11] 4,141,469

[45] Feb. 27, 1979

[54] MICRODISPENSING DILUTION SYSTEM

[76] Inventor: Thomas E. Lee, 3983 Canyon Rd., Lafayette, Calif. 10573

[21] Appl. No.: 793,080

[22] Filed: May 2, 1977

[51] Int. Cl.[2] ..... B67D 5/46

[52] U.S. Cl. ..... 222/135; 73/425.6; 222/340; 417/519

[58] Field of Search ..... 222/144.5, 145, 333, 222/309, 383, 135, 137, 340, 341; 73/425.6, 421 R; 23/253 R, 259; 128/218 A; 417/518, 519

[56] References Cited

U.S. PATENT DOCUMENTS

| | | | |
|---|---|---|---|
| 3,012,863 | 12/1961 | Feichtmeir | 23/259 X |
| 3,419,051 | 12/1968 | Gustafson et al. | 222/145 X |
| 3,815,790 | 6/1974 | Allen et al. | 222/309 |
| 3,948,605 | 4/1976 | Atwood et al. | 23/253 R X |

FOREIGN PATENT DOCUMENTS

| | | | |
|---|---|---|---|
| 1498969 | 11/1968 | Fed. Rep. of Germany | 73/425.6 |

*Primary Examiner*—Allen N. Knowles
*Assistant Examiner*—Fred A. Silverberg

[57] ABSTRACT

A dilution system which employs hand manipulated microdispensers including a power actuator for discharging diluent from one or more microdispensers through a flexible conduit to a remote handle carrying a sample microdispenser and a control for the actuator arranged for single-handed dispensing of a sample and diluent.

8 Claims, 3 Drawing Figures

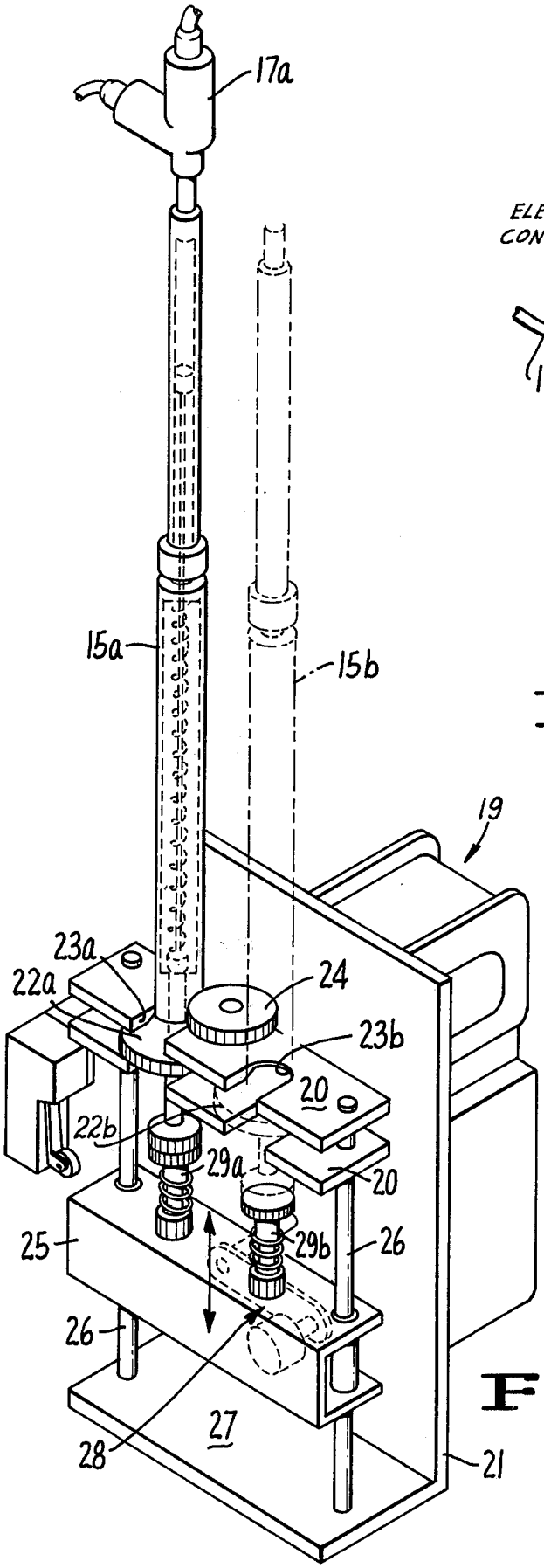
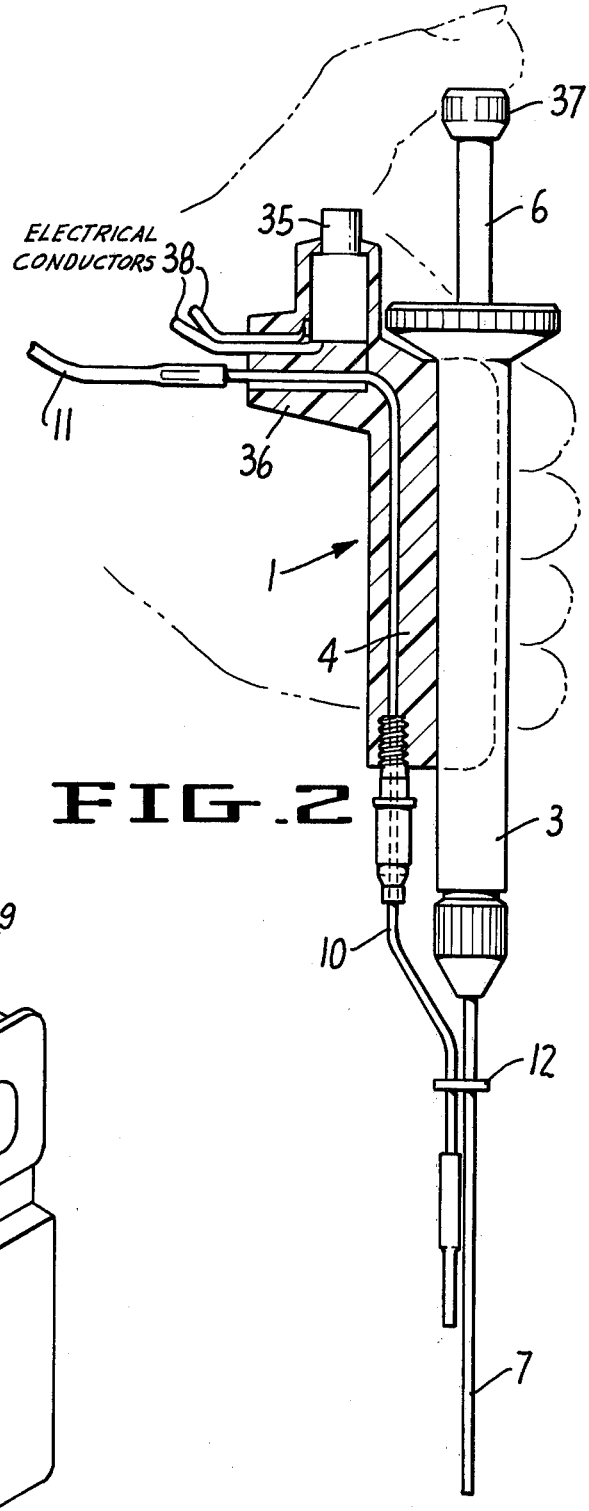
FIG. 2
FIG. 3.

MICRODISPENSING DILUTION SYSTEM

BACKGROUND OF THE INVENTION

Frequently during use of microdispensers of the type disclosed in U.S. Pat. No. 3,815,790 for Precision Liquid Pipetting Devices issued July 11, 1974 it is desirable or necessary to dispense into the same test tube or location various diluents or reagents to accompany a sample carried in the microdispenser. Various means have been used to dispense these diluents or reagents including additional hand manipulated microdispensers arranged as pumping means such as is disclosed in co-pending application Ser. No. 662,942 filed Mar. 1, 1976, now abandoned by Thomas E. Lee for "Pipetting Devices". Sometimes the operator needs to dispense the sample first followed by one or more diluents. At other times, discharge of the sample into previously dispensed diluent is the desired procedure.

SUMMARY OF THE INVENTION

The microdispensing dilution system of this invention uses precision, positive displacement, microdispensers of the type described in U.S. Pat. No. 3,815,790 arranged so that a sample carried in one microdispenser can be dispensed in any sequential relation to diluent dispensed or pumped by remotely located and power operated microdispensers by one-handed manipulation of the sample microdispenser and a control means for power operating the diluent microdispensers.

A principal object of this system is to provide a dilution arrangement whereby a microdispensed sample can be diluted or combined with reagent in any predetermined sequence in a one-handed operation which requires manual manipulation of only a single sample microdispenser.

Another object of the invention is to provide a dilution system that utilizes available microdispensers and the advantage of their positive displacement, precision quantity dispensing capability.

One other object of the invention is to provide a dilution system which is simple, inexpensive and without the inacuracies of known flow-through systems.

Other objects and advantages of the system of this invention will become apparent upon consideration of a specific embodiment described in connection with the accompanying drawings.

IN THE DRAWINGS

FIG. 2 illustrates the handle for the sample microdispenser of the system; and

FIG. 3 illustrates a form of remote power actuator for supplying diluent to the system from one or more diluent microdispensers.

Figure 1:
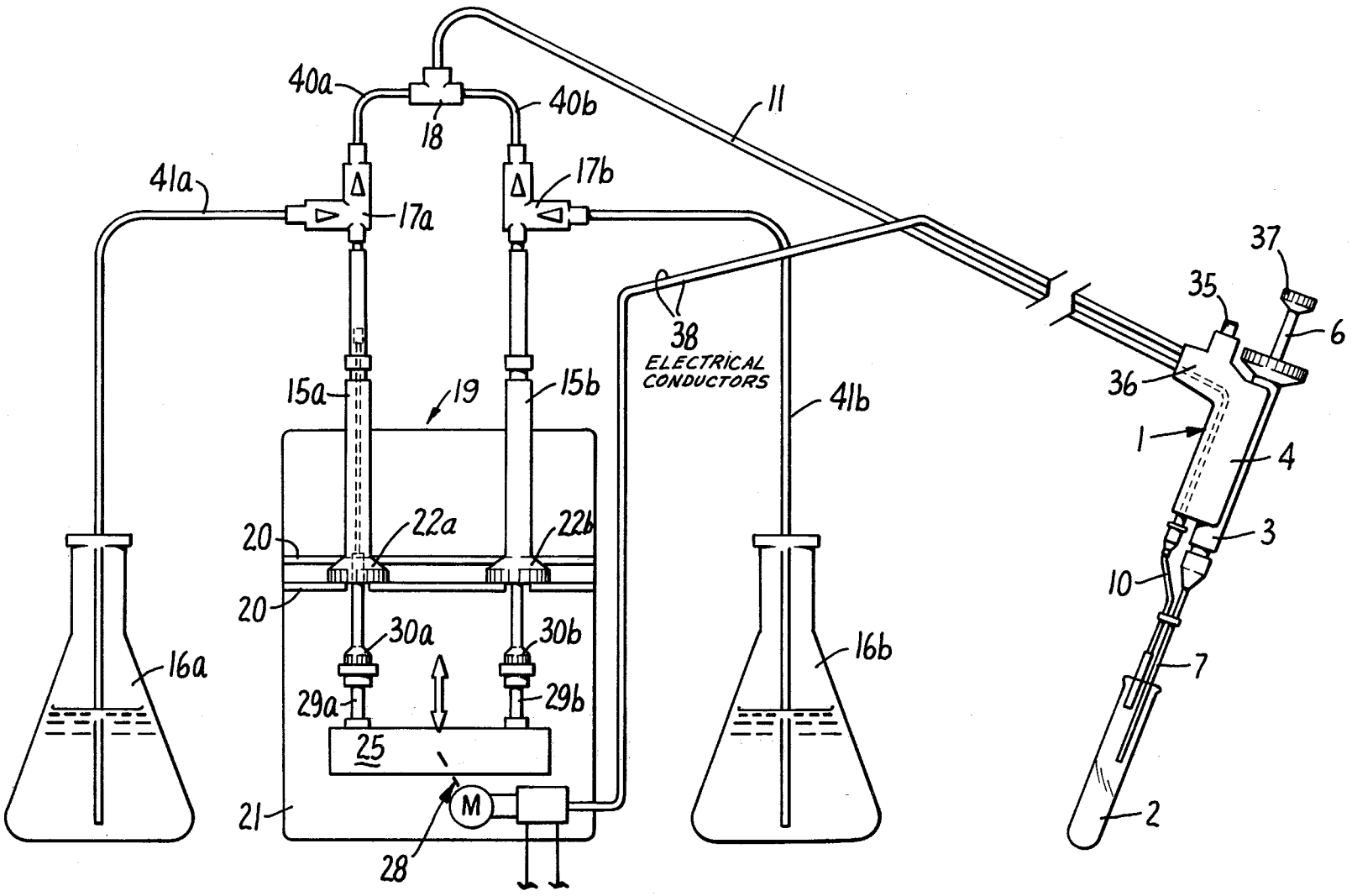
FIG. 1 is a schematic diagram of the microdispensing dilution system.

The microdispensing dilution system of FIG. 1 includes a handle 1 and sample microdispenser assembly for dispensing a sample and diluent or reagent into a test tube 2, for example. Sample microdispenser 3 carrying a fluid sample is releasably snapped by a press-fit into the partial tubular barrel 4 of the handle 1 which may molded for example from semi-resilient plastic materials.

The microdispenser 3 is of the type disclosed in FIG. 2 of U.S. Pat. No. 3,815,790 for drawing up and then dispensing small liquid samples by positive displacement as is more fully described in that patent. A thumb operated plunger 6 biased upwardly by an internal spring draws sample into the disposable dispenser pipette 7. The plunger 6 then may be depressed by the operator's thumb, against the internal spring bias as shown in FIG. 2, to dispense sample through pipette 7 into test tube 2.

As is more particuarly shown in FIG. 2, the handle 1 includes conduit means 10 disposed alongside part of the length of the pipette 7 of sample microdispenser 3 and running internally through the handle barrel 4 into communication with a flexible conduit 11 which may be, for example, flexible laboratory tubing. Conduit means 10 carries a pipette guide 12 through which pipette 7 may removeably pass. The flexible conduit 11 conducts diluent to conduit means 10 for discharge adjacent to the microdispenser pipette 7 into test tube 2 from a diluent microdispenser arrangement shown schematically in FIG. 1.

That arrangement includes one or more diluent microdispensers 15*a*, 15*b* of the type illustrated in FIG. 1 of U.S. Pat. No. 3,815,790 herein shown to pump diluent or reagent from corresponding flask reservoirs 16*a*, 16*b* through three-way valve means 17*a*, 17*b* and tee fitting 18 into flexible conduit 11. The diluent microdispensers 15*a*, 15*b* mount on a motor driven power actuator 19 which operates the dispensers at a location which may be remote from the handle 1.

The particular power actuator 19 shown in FIG. 3, includes fixed yoke plates 20 spaced from one another and mounted on an L-shaped stand 21. These yoke plates 20 embrace the generally circular head 22*a*, 22*b* of each diluent microdispenser between them in recesses 23*a*, 23*b*. The microdispensers 15*a*, 15*b* may be locked in position in those recesses by means of an eccentric controlled by knurled nob 24, for example. A channel-shaped movable yoke 25 travels vertically upon a pair of space rods 26 extending from the fixed yoke plates 20 to the bottom leg 27 of stand 21. Movable yoke 25 is traversed vertically by means of electrical motor driven crank mechanism shown generally at 28. The movable yoke 25 carries a spring-biased pusher 29*a*, 29*b* for each diluent microdispenser 15*a*, 15*b*. These pushers are resiliently biased in the vertical direction and abut against the button head 30*a*, 30*b* on the end of each diluent microdispenser plunger. The motor drive for crank mechanism 28 is controlled remotely by control means 35, in this case a push button microswitch, mounted on a top shoulder 36 of handle 1 in a location adjacent to the push button 37 for the plunger of the sample microdispenser 3. The plunger 6 and microswitch 35 thus can be easily manipulated by the thumb of the operator as is suggested in FIG. 2. Electrical conductors 38 connect the microswitch to the motor of the crank mechanism 28. These conductors and the flexible conduit 11 may be sheathed together to provide a single flexible structure extending from the power actuator to the remotely operable handle.

In operation, the operator with a single hand grasps the handle with his fingers around the barrel 4 as shown in FIG. 2 and operates either the plunger 6 of the sample microdispenser 3 or the push button on switch 35, in any preferred sequence, with his thumb. For example, sample may first be picked up and discharged into the test tube 2 by depressing plunger 6 of the sample microdispenser 3 by the operator's thumb. Then, diluent may be dispensed in known quantity into the test tube by the operator without changing his grasp by depressing the push button of microswitch 35 to energize the power actuator 19. The motor driven crank assembly 28 then translates movable yoke 25 upwardly to depress the plungers of one or more diluent microdispensers 15*a*, 15*b* to dispense their contents through the vertical check valve in three-way valves 17*a*, 17*b* and conduits 40*a*, 40*b* through tee 18 into flexible conduit 11. Diluent moves through conduit 11 and interconnecting conduit means 10. An amount equal to that dispensed by the diluent microdispenser discharges into the test tube 2 adjacent to the tip of the pipette 7 of the sample microdispenser. The power actuator has an arrangement of microswitches (not shown completely) so that the motorized crank assembly 28 upon discharge of the contents of a diluent microdispenser 15*a*, 15*b* then moves yoke 25 downwardly permitting the spring bias in those microdispensers to force the dispenser plungers downwardly and thus pump into each dispenser a new volume of diluent from reservoirs 16*a*, 16*b* through suction conduits 41*a*, 41*b*, respectively.

At the operator's option additional diluent can be discharged into test tube 2 by again depressing the push button of switch 35 or the operator can pick up a new sample with the sample microdispenser and repeat the operation. As an alternative, diluent may first be dispensed into the test tube 2 followed by the sample from microdispenser 3 as will be apparent from a consideration of the foregoing description and FIG. 1.

Various modifications of the described specific embodiment will become apparent to those familiar with this art without departing from the scope of the invention which is defined in the following claims.

I claim:

1. A system for diluting a precise quantity of fluid sample with diluent comprising a handle;

a manually operable sample microdispenser carrying the sample and mounted on the handle;

at least one diluent microdispenser remote from the handle for dispensing diluent;

a flexible conduit communicating the diluent microdispenser to the handle for discharge of diluent adjacent to sample dispensed from the sample microdispenser;

a power actuator for operating the diluent microdispenser;

and control means for the power actuator to dispense diluent.

2. The system of claim 1 wherein the control means is mounted on the handle.

3. The system of claim 2 wherein the handle includes a partial tubular barrel into which the sample microdispenser is press-fit and which is circumferentially grasped by the fingers of the operator so that the plunger of the sample microdispenser can be manually depressed to dispense sample;

a shoulder adjacent to said barrel for carrying the control means in the vicinity of the sample microdispenser plunger; and conduit means carrying diluent from the flexible conduit to a location adjacent to the sample discharge of the sample microdispenser.

4. The system of claim 2 wherein the control means is an electrical switch.

5. The system of claim 3 wherein the plunger of the sample microdispenser and the control means is operable by the thumb of the operator's hand which grasps the handle barrel.

6. In system for diluting a precise quantity of fluid sample with diluent having a manually operable sample microdispenser carrying the sample, power actuated diluent dispensing means remote from the sample microdispenser and a flexible conduit conducting diluent from said dispensing means, the improvement comprising a handle having a partial tubular barrel into which the sample microdispenser is press-fit and which is circumferentially grasped by the fingers of the operator so that the plunger of the sample microdispenser can be manually depressed to dispense sample;

a shoulder adjacent to said barrel in the vicinity of the sample microdispenser plunger;

conduit means carrying diluent from the flexible conduit to a location adjacent to the sample discharge of the sample microdispenser; and control means for said diluent dispensing means carried on the shoulder.

7. A power actuator for dispensing diluent from at least one microdispenser having an elongated barrel terminating at one end in a head with a movable plunger within the barrel having a button head thereon and a bias spring so positioned to return the plunger to a withdrawn end of its stroke comprising:

a pair of fixed yoke plates spaced from one another to embrace the microdispenser head between them and each fixed yoke plate having a side-opening recess, one recess receiving the elongated barrel and the other recess passing the plunger of the microdispenser that is insertable through the open side of the recesses;

a movable yoke translatable into pushing engagement with the button head of the plunger of the microdispenser against resistance of the bias spring to a second fully extended position; and power drive means translating the movable yoke toward the fixed yoke plates and into pushing engagement with the button head of said plunger to move said plunger away from the withdrawn end of its stroke to the second fully extended position and then retracting the movable yoke from the fixed yoke plates to enable the bias spring to return the plunger to said withdrawn end of the stroke.

8. The power actuator of claim 7 further including remotely operable control means for selectively operating the power drive means.

* * * * *